United States Patent [19]

Horn

[11] Patent Number: 4,625,213

[45] Date of Patent: Nov. 25, 1986

[54] ANTENNA MOUNT

[75] Inventor: Dale W. Horn, Brecksville, Ohio

[73] Assignee: Orion Industries, Inc., Cleveland, Ohio

[21] Appl. No.: 676,630

[22] Filed: Nov. 30, 1984

Related U.S. Application Data

[63] Continuation of Ser. No. 228,938, Jan. 28, 1981, abandoned.

[51] Int. Cl.[4] ..... H01Q 1/32

[52] U.S. Cl. ..... 343/715

[58] Field of Search ..... 343/702, 715, 900

[56] References Cited

U.S. PATENT DOCUMENTS

| | | | |
|---|---|---|---|
| 2,558,763 | 7/1951 | Lee | 343/715 |
| 2,668,187 | 2/1954 | Von Wald et al. | 343/900 |
| 2,886,814 | 5/1959 | Williams | 343/900 |
| 3,453,618 | 8/1969 | Ukmar et al. | 343/715 |
| 4,028,704 | 6/1977 | Blass | 343/900 |
| 4,134,120 | 1/1979 | DeLoach et al. | 343/715 |

*Primary Examiner*—Eli Lieberman

*Attorney, Agent, or Firm*—Dressler,Goldsmith,Shore,Sutker, &Milnamow, Ltd.

[57] ABSTRACT

Antenna mount comprised of an essentially tubular length of an elastomer, to which, at one end, a fitting adapted to receiver an antenna is secured and, at the other, a fitting adapted to receive a lead-in connector is also secured. A flexible conductor extends between the portions in the fittings where electrical contact is made with, respectively, the antenna and a coupler for the lead-in to the radio set. Noise-free duplexing can be obtained.

16 Claims, 1 Drawing Figure

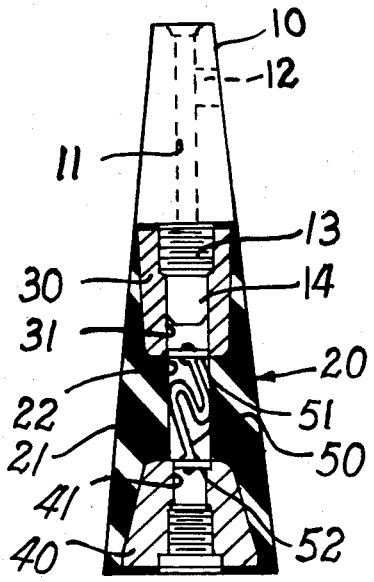
10
12
11
13
30
14
31
20
22
51
21
50
41
52
40

ANTENNA MOUNT

This invention relates to an improvement in an antenna mount, and more particularly, to such a mount for mobile radio communication in which there is duplex operation of the antenna, i.e., simultaneous transmission and reception of radio signals; this application is a continuation of my application Ser. No. 228,938, filed Jan. 28, 1981, now abandoned.

From the very outset of mobile radio communication, as between a base station and one or more automotive vehicles or between two or more automotive vehicles, it has been conventional to employ so-called "whip" antenna on the vehicles, i.e., antennas essentially consisting of long conductive rod. It has been equally conventional to mount such antennas on the vehicles by a mount comprising of a base affixed to the vehicle; a metallic spring in which the lower end of the whip is fastened, the lower end of the spring being connected to the base; and a flexible conductor, usually insulated, located within the spring and extending between the lower end of the antenna and means carried by the base for coupling the conductor to the lead-in cable (usually a co-axial cable) by which the antenna is thus connected to the radio set within the vehicle. Such springs have been lengths of heavy wire helically wound into a "bell" shape, i.e., bulged between its ends, in order to provide greater flexibility by providing a greater length of wire subject to a torsion load as the spring is flexed than if the wire were helically wound in a cylindrical or conical shape. The necessary function of the spring in such an antenna mount for mobile communication is to permit the antenna whip to fold downwardly at the mount when the upper portion of the whip strikes an overhead obstruction which would otherwise bend or break the whip.

A heretofore seemingly unrelated problem encountered in mobile radio communication has arisen during attempts at duplex operation, i.e., when radio frequencies were simultaneously transmitted and received. Whereas such duplexing permitted transmission and reception which was as clear and noise-free as simplex operation (either transmission or reception) when a vehicle was completely stationary, any duplexed transmission or reception while the vehicle was moving was so overwhelmed by "noise" as to make duplexing wholly impractical. As a consequence, the mobile communication ratio sets in a vehicle while "transceive" (transmit and receive) have conventionally been designed to operate only in either a "transmit mode" or a "receive mode".

It is the object and purpose of this invention to provide a mobile communication antenna, or more particularly, an antenna mount, which permits duplexing which is as noise-free as simplexing.

Other objects and advantages of this invention will be apparent from the following specification, the accompanying drawing which is a cross-section in part of a preferred antenna mount component made according to this invention.

Referring to the drawing, a conical metallic adapter 10 is drilled lengthwise to provide a bore 11 in which the lower end of an antenna whip (not shown) is received and held by a setscrew 12. The lower end of the adapter 10 is provided with a projection comprised of a threaded section 13 and a pilot extension 14.

The molding 20 is comprised of a body 21, an upper fitting 30, and a lower fitting 40, the fittings 30 and 40 being of non-corrosive, electrically conductive metal molded in as inserts when the body 21 is formed, preferably by compression or so-called transfer molding in the cavity of a suitable die cored to form a passage 22 connecting the bores of the fittings 30 and 40.

The material of the body 21 is a non-conductive elastomer having low-temperature flexibility. In the preferred embodiment, the body 21 is a neoprene compounded to provide a 70 durometer hardness, to remain flexible at temperatures as low as −40° F. (which is also −40° C.), and to bond securely to the metal of the fittings 30 and 40. To secure the fittings in the molding 20 by bonding, they may be coated with an adhesion-promoter prior to molding. To increase the bonding area and also provide a degree of mechanical interlock between the elastomer and the fittings, the external surfaces of the fittings 30 and 40 may be knurled, ribbed, or flanged.

As shown in the drawing, the upper fitting 30 is a short length of heavy-walled tubing having an internal bore 31 which is counter-bored and tapped at its upper end to receive the threaded section 13 of the adapter 10, the pilot extension 14 making a mechanically close and electrically conductive fit with the untapped bore 31 of the upper fitting 30. The lower fitting 40 having a similar bore 41 and which is counter-bored and tapped to receive a conventional coupler (not shown) which electrically couples a lead-in cable to the radio set within the vehicle to the lower fitting 40, which coupler may also mechanically connect or aid in the mechanical connection of the molding 20 to any suitable and conventional mounting base (not shown) whereby the mount is affixed to the vehicle at a suitable location, such as the roof, body, mirror mount, or, as in very early mobile radio communication antenna mounts, the bumper of the vehicle.

The length and proportions of the molding 20 are determined by the flexibility of the selected elastomer between the fittings 30 and 40, to which flexibility the passage 22 contributes. Preferably this flexibility is such that, when the antenna whip is struck or otherwise subjected to a severe horizontally directed load, the body 21 will fold in its portion between the fittings 30 and 40 (tending to collapse the passage 22) to permit the whip to be deflelted from the vertical without damage to the whip. Preferably this flexibility is also such as to permit a deflection, if necessary, of the whip to nearly 90° from the vertical in any direction (i.e., 360°) when the base of the molding 20 is horizontal while, at the same time, the stiffness of the molding 20 is sufficient to maintain, under normally encountered wind-loads, the antenna whip so that the whip would be nearly vertical if the whip, itself, were not also flexed by such wind loads.

The fittings 30 and 40 are electrically connected. Usually this electrical connection is most conveniently made after the fittings 30 and 40 have been molded in the molding 20 and the molding has been removed from the molding die cavity. In the embodiment shown, a length of a very flexible conductor 50 (usually a braid of fine copper wire) is soldered at one end to a metal washer 51 having an O.D. permitting it to be force-fitted into the bore 31 of the fitting 30. With the other (and temporarily free) end of the conductor 50 dropped through the passage 20 and into the bore 41 of the lower fitting, the washer 51 is forced down to the loer end of the bore 31, so that the free end of the conductor 50 extends beyond and out of the lower fitting 40. A second washer 52 is then first soldered to the free end of the conductor 50 and thereafter force-fitted into the upper end of the bore 41 in the lower fitting 40. The conductor 50 folds upon itself within the passage 22, providing an ample length to permit the molding 20 to be bent as much as 90° at the portion in which the passage 22 is located without putting tension on the soldered connections of the conductor 50 to its holding washers 51 and 52.

The primary advantage of an antenna mount, or more precisely, an antenna mount component, made as described above is that it permits noise-free duplexing of mobile radio communications; it confirms my suspiction that, rather than being due to the fact that the vehicle was moving and thereby accentuating any variations in radiations between the transmitting and receiving antennas, the real cause of the noise problem heretofore encountered in the duplexing of mobile radio communications was DC static created by the flexing, often very slight and physically imperceptible, of the metal wire springs (heretofore conventionally used and regarded as necessary for an antenna mount on a vehicle) when radio frequency was imposed on an a antenna for simultaneous transmission and reception. Another advantage is that molded elastomeric body 21 serves the necessary mechanical functions of a heretofore conventional antenna mount spring.

This invention is not restricted to the particular embodiment disclosed. For example, the connection between the upper fitting 30 and the adapter 10 need not be threaded but, provided an electrical connection is made between the pilot projection 14 (or equivalent) and upper fitting 30, the adapter and fitting may be joined by a suitable adhesive, such as an epoxy. Nor need the adapter 10 and fitting 30 be made as separate parts but may be made as a single element, provided that any flash which is likely to occur (as when the outer surface of a molding and protruding insert is continuous) is not objectionable as a matter of appearance. In order to obtain equal flexibility of the molding 20 from the vertical in any direction, the molding 20 is preferably in the form of a solid of revolution, such as the truncated cone shown in the drawing. However, in some applications it may be desirable that the body 21 be less flexible in one direction than in others, as for example when the antenna is intended to be mounted on the side of a vehicle which may be struck as the antenna whip deflects under wind loads in normal operations; for such cases, the molding 20 may be molded with a stiffening rib extending in the direction in which less flexibility is desired, which rib may also serve as a flange by which the molding 20 can be secured to a side-mounting base. Nor need the elastomer for which the molding 20 is formed be confined to a neoprene, the preferred elastomer in the present state of that art as I am aware of it. The art of elastomers as now developed or as it evolves may well permit the selection of other elastomers. This invention may, therefore, be varied and modified by those skilled in the art without departing from the scope and spirit of the appended claims.

What is claimed is:

1. A mobile communications antenna coupler-mount for deflectably mounting and supporting an antenna whip, usable for duplex operation, and for coupling said antenna whip to a lead-in conductor comprising:

a first fitting for receiving and coupling the lower end of the antenna whip to said coupler-mount;

a second fitting coupleable to the lead-in conductor, said second fitting being physically spaced from said first fitting;

a one-piece, insulating, elastometric body having deflectable, support sidewalls and first and second ends, said first fitting being received in said first end, with said second fitting being received in said second end and insulated from said first fitting, said first fitting being deflectable with said first end from an initial position of rest relative to said second fitting, said insulating body providing the sole restoring force to return said first fitting from a deflected position to said initial position of rest, said body defining a deformable space of a selected shape and length between said fittings, said first fitting and the antenna whip being supported in spaced relation to said second fitting only by said support sidewalls; and an elongated, flexible, conducting member positioned in said space, said conducting member being mechanically connected to said fittings, and being electrically coupleable at said fittings to an antenna whip and a lead-in conductor, thereby to provide a noise-free electrical connection between the antenna whip and said second fitting as said elastomeric body is deflected.

2. The antenna coupler-mount as defined in claim 1 wherein said conducting member is folded upon itself within said space to compensate for deformation of said space as said first fitting is deflected relative to said second fitting.

3. The antenna coupler-mount as defined in claim 1 wherein said elastomeric body is molded in the form of a selected solid of revolution.

4. The antenna coupler-mount as defined in claim 1 wherein said sidewalls have a varying thickness.

5. The antenna coupler-mount as defined in claim 1 wherein the length of said flexible, conducting member in said space exceeds said spacing between said fittings.

6. The antenna coupler-mount as defined in claim 5 wherein said conducting member is an uncoiled metal wire.

7. The antenna coupler-mount as in claim 5 wherein said conducting member is a braided metal wire.

8. The antenna coupler-mount as defined in claim 1 wherein said support sidewalls tend to restore said first fitting to said initial position of rest, relative to said second fitting, in response to the relief of forces deflecting the antenna whip.

9. The antenna coupler-mount as in claim 1, and wherein said fittings are metallic and said conducting member comprises a metal wire, and wherein said coupler-mount further includes means electrically coupling said metal wire and said fittings to each other.

10. The antenna coupler-mount of claim 9, and wherein said space is an open passage between said fittings.

11. The antenna coupler-mount as defined in claim 10 wherein said passage has a cross-sectional dimension less than the cross-sectional dimensions of said first and second fittings.

12. A mobile communications antenna coupler-mount for deflectably supporting an antenna whip, usable for duplex operation, and for coupling said antenna whip to a lead-in conductor comprising:

a first fitting for receiving and coupling the lower end of the antenna whip to said coupler-mount;

a second fitting coupleable to the lead-in conductor, said second fitting being physically spaced from said first fitting;

an elongated, one-piece flexible, insulating body with first and second ends, said body defining a passage between said ends with said passage tending to deform as said body is flexed from a position of rest, said insulating body providing the sole restoring force to return said first fitting from a deflected position to said position of rest;

said first fitting being received in said first end, said second fitting being received in said second end with only said body supporting said fittings in spaced relation to one another; and flexible, means for conduction positioned in said passage and mechanically and electrically coupled to said fittings for providing a noise-free electrical connection between said fittings as said body flexes and as said passage deforms.

13. The antenna coupler-mount as defined in claim 12 wherein said sidewalls have a variable thickness.

14. The antenna coupler-mount as defined in claim 12 wherein said means for conduction comprises a braided metal wire.

15. The antenna coupler-mount as defined in claim 14 wherein said wire has a greater length than the spacing between said fittings, thereby to compensate for deformation of said passage as said body flexes.

16. The antenna coupler-mount as defined in claim 12, and wherein said fittings are metallic and said conduction means comprises a metal wire, and means electrically coupling said metal wire and said fittings to each other, and wherein said metal wire is positioned in said passage and is of a length greater than the length of said passage.

* * * * *